US006465024B1

(12) United States Patent
Di Scala et al.

(10) Patent No.: US 6,465,024 B1
(45) Date of Patent: Oct. 15, 2002

(54) BABY BOTTLE WITH PUMP

(76) Inventors: Luciano Di Scala, 111 Arpage Dr. East, Shirley, NY (US) 11967; Frank Ida, 1 Jillet Dr., Smithtown, NY (US) 11787

( * ) Notice: Subject to any disclaimer, the term of this patent is extended or adjusted under 35 U.S.C. 154(b) by 0 days.

(21) Appl. No.: 09/537,478

(22) Filed: Mar. 30, 2000

Related U.S. Application Data

(63) Continuation-in-part of application No. 08/991,368, filed on Dec. 16, 1997, now Pat. No. 6,042,850, which is a continuation-in-part of application No. 08/517,709, filed on Aug. 21, 1995, now Pat. No. 5,699,920.

(51) Int. Cl.[7] ..... A51J 9/00

(52) U.S. Cl. ..... 426/2; 215/11.1; 215/11.3; 215/11.4; 215/11.5; 215/11.6; 426/115; 426/117

(58) Field of Search ..... 215/11.1, 11.3, 215/11.4, 11.5, 11.6; 426/117, 115, 2

(56) References Cited

U.S. PATENT DOCUMENTS 2,846,103 A 8/1958 Maxwell
2,907,485 A 10/1959 Lunden
3,648,873 A * 3/1972 Grobbel ..... 215/11 R
4,176,754 A 12/1979 Miller
4,821,896 A * 4/1989 Cheng ..... 215/11.3
4,880,125 A 11/1989 LeBeau
5,033,631 A * 7/1991 Nightingals ..... 215/11.1
5,431,290 A * 7/1995 Vinciguerra ..... 215/11.5
5,524,783 A 6/1996 Popoff
5,687,861 A 11/1997 Wiedemann
5,921,426 A 7/1999 Randolph

* cited by examiner

*Primary Examiner*—Milton I. Cano
*Assistant Examiner*—H. Mai

(57) ABSTRACT

A nursing bottle having a rigid body, an open end, and an aperture, a flexible liner suspended from the open end of the body, a feeding nipple attachable to the open end of the body. An attached, slidably engagable, pump for pumping air into the chamber between the liner and body. The pump pressurizes the chamber and expels air from the liner. An air regulating device permits airflow in and out of the chamber in restricted quantity, so when pressure is applied to the pump, there is an increase of pressure within the chamber to force out the air trapped within the liner. The pump, also fashioned to be the protective storage hood for the nipple.

14 Claims, 3 Drawing Sheets

BABY BOTTLE WITH PUMP

RELATED APPLICATION

This is a continuation-in-part of application Ser. No. 08/991,368 filed Dec. 16, 1997 now U.S. Pat. No. 6,042,850, which is a continuation in part of Ser. No. 08/517,709 filed Aug. 21, 1995, U.S. Pat. No. 5,699,920.

BACKGROUND OF THE INVENTION

The present invention relates to nursing bottles, more particularly, the type that utilize disposable liners, and the removal of air from the inside of these liners prior to feeding. Air that is trapped in a liner of a nursing bottle is often ingested by the baby feeding from the nursing bottle. This air ends up in the baby's stomach and can cause pain and regurgitation. The elimination of the air from the liner prevents the baby from ingesting the air and so reduces the possibility of the negative side effects associated with air in the baby's stomach.

The problem of air in a disposable liner of nursing bottles has been recognized for some time. The prior art disclose devices, which are used to eliminate air from the liner. For example, the prior art disclose the use of plungers, such as those disclosed in U.S. Pat. No. 5,524,783 to Popoff, and U.S. Pat. No. 4,880,125 to LeBleau. The end of the plunger is used to mechanically collapse the liner toward a nipple on the nursing bottles, which causes a decrease in volume of the liner. As the liquid in the liner moves upward in response to the mechanical pressure from the plunger, the air in the liner is expelled through the nipple. A similar device is disclosed in U.S. Pat. No. 4,176,745 to Miller that has a pneumatic member (12) that applies a force to a liner to expel air in the liner.

The problems with these devices are if the plunger or pneumatic member is removed, there is nothing to prevent the liner from re-expanding and air being reintroduced into the liner. When the air re-enters the liner, it must be collapsed again before the nursing bottle is used to feed an infant, and there is a separate accessory that must be carried with the bottle to expel the air.

Many nursing bottles use disposable liners. These liners provide for easy cleaning as they are simply thrown away after use and replaced. Many of these nursing bottles have apertures in the bottom to allow air into the bottle as the baby takes liquid from the nursing bottle. This allows the pressure around the liner to be equal to the pressure outside of the nursing bottle. An example of these types of nursing bottles is U.S. Pat. No. 2,846,103 to Maxwell.

The problem with these bottles is they don't provide a means to remove the air trapped in the liner prior to feeding. Still other nursing bottles, such as Wiedemann, U.S. Pat. No. 5,687,861 and Randolph, U.S. Pat. No. 5,921,426 use liners and no valves. These bottles have a soft outer shell body that when hand pressure is applied to the container, the container collapses and direct contact is made with the liner exhausting air from the liner. The problem with these bottles is that when the liner has only a few ounces of fluid, an excessive amount of hand pressure must be applied, making it difficult to remove the air from the liner.

SUMMARY OF THE INVENTION

Accordingly, it is an object of the present invention to provide nursing bottles, especially intended for human infants or animals, which utilize air pressure to collapse a liner and expel air from the liner, e.g., expel air out of the liner via the nipple. More particularly, a nursing bottle having a rigid body, an open end, and an aperture, a flexible liner suspended from the open end of the body, a feeding nipple attachable to the open end of the body. An attached, slidably engagable, pump for pumping air into the chamber between the liner and body. The pump pressurizes the chamber and expels air from the liner. An air regulating means permits airflow in and out of the chamber in restricted quantity, so when pressure is applied to the pump, there is an increase of pressure within the chamber to force out the air trapped within the liner. The pump, also fashioned to be the protective storage hood for the nipple.

It is another object of the present invention to provide a nurser with an airflow regulating mean, the air regulating means being an orifice, or a course or passage through which air may move or be directed between close fitting parts. When pressure is applied to the pump, air escapes through the air regulating means, however there is sufficient pressure to expel air from the liner. When the pump is drawn out of the body, air enters the chamber through the same air regulating means, so the pump can be pumped again. The airflow regulating means is designed to be less restrictive than the orifice of the nipple so that air does not readily reenter the liner. In another embodiment, the slidable pump, pumps air through a valve to pressurize the air in the chamber and expel air from the liner.

It is another object of the present invention to provide nursing bottles that promotes upright feeding by keeping the nipple full of liquid during feeding.

It is another object of the present invention to provide nursing bottles that are easy to use and operate.

It is a further object of the present invention to provide nursing bottles that are easy to remove air from the liner prior to feeding.

It is a further object of the present invention to provide nursing bottles that are economically and easily manufactured for widespread sale and use.

BRIEF DESCRIPTION OF THE DRAWINGS

Other objects and features of the present invention will become apparent from the following detailed description considered in connection with the accompanying drawings that disclose several embodiments in the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
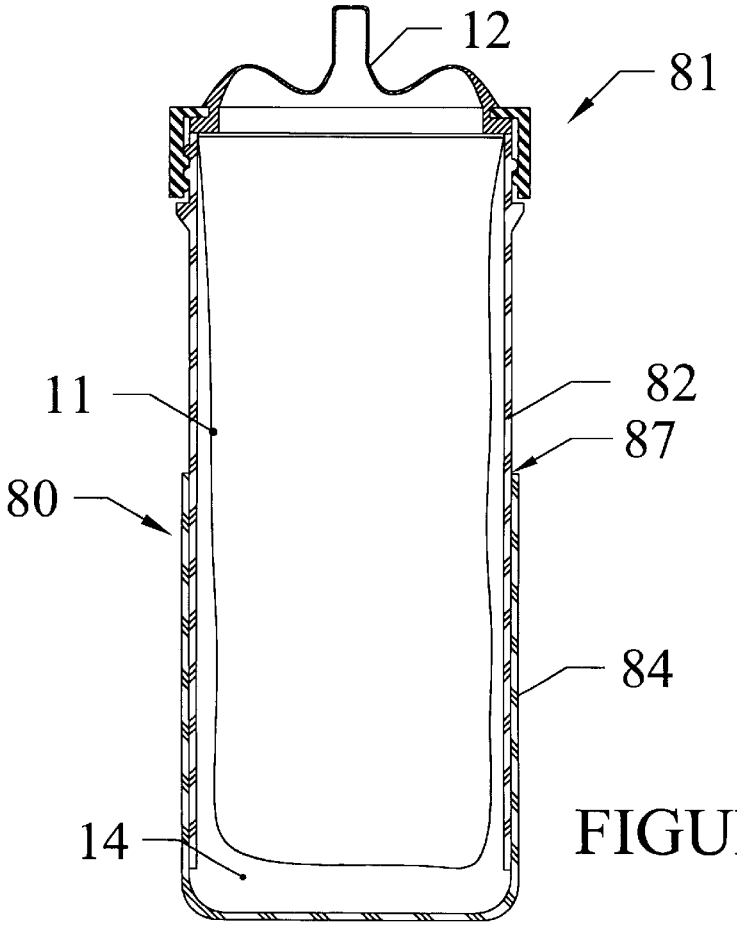
FIG. 1 is a cross-sectional view of the nursing bottle according to the present invention in which the nursing bottle shown in FIG. 2 illustrated in an initial state with air in the liner, e.g., prior to feeding.

Referring to FIG. 1 illustrates the embodiment of the present invention for a nursing bottle 81 having a body 80 comprising two parts, an upper portion 82 comprising a hollow substantially cylindrical tube having an open upper end and an open bottom end, and a lower portion 84 comprising an open upper end and closed bottom end. Upper and lower portions 82 and 84, respectively, are telescopically slidably and engageable with each other in, close fitting manner to pressurize air in chamber 14.

Figure 2:
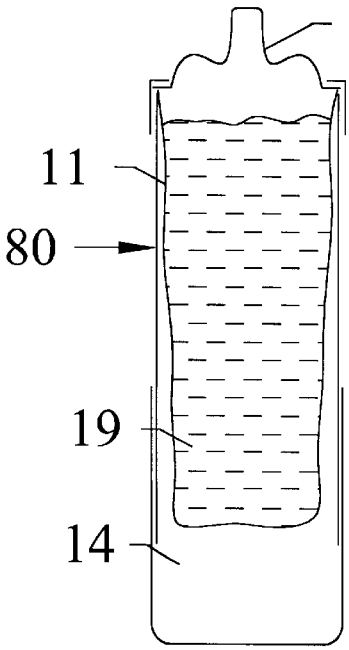
Figure 3:
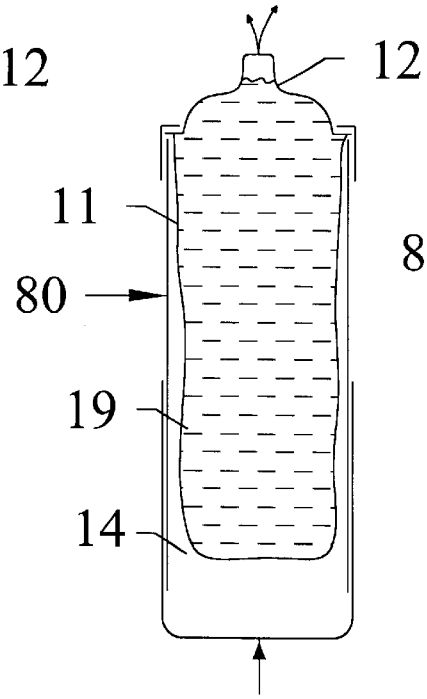
FIG. 3 is a cross-sectional view of the nursing bottle shown in FIG. 2 in which a lower portion of the body is slidable relative to the upper portion so that liquid in the liner rises and air is expelled from the liner.
Figure 4:
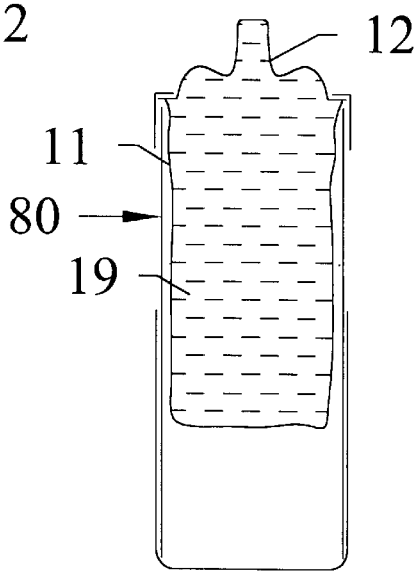
FIG. 4 is a cross-sectional view of the nursing bottle shown in FIG. 3 with no air in the liner, e.g., ready for feeding.

The operation of nursing bottle 81 is best shown in FIGS. 2–4. FIG. 2 shows the nursing bottle 81 with liner 11 initially filled with liquid 19 and air, e.g., prior to feeding. FIG. 3 shows manually sliding lower body portion 84 relative to upper body portion 82, e.g., holding upper portions 82 and pushing lower body portion 84 down on a table top. As the body portions move relative to each other, air pressure in chamber 14 is increased which acts on liner 11 to cause liquid 19 in liner 11 to rise, air in chamber 14 also escapes through air passage 87, but air in liner 11 is expelled through the orifice in nipple 12 too.

After this process, as shown in FIG. 4, liner 11 has no air. During feeding, when the chamber's volume increases a sufficient amount, the pumping process can be performed again.

Figure 5:
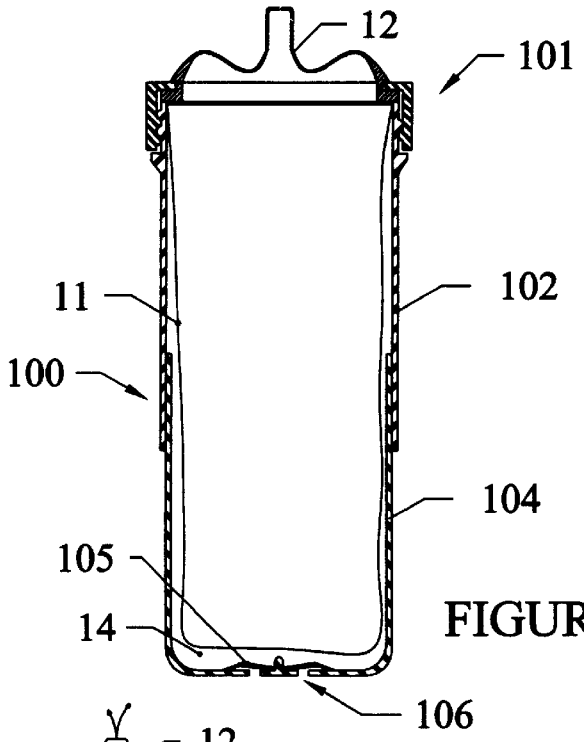
FIG. 5 is a cross-sectional view of another embodiment of a nursing bottle according to the present invention in which the nursing bottle includes a two-part body and a check valve.
Figure 6:
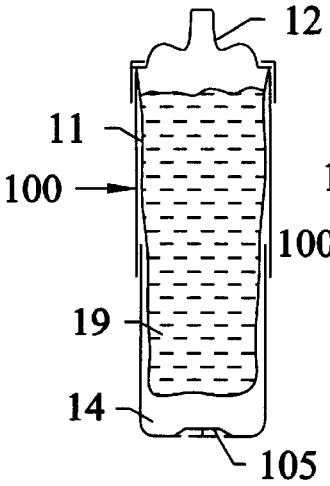
FIG. 6 is a cross-sectional view of the nurser shown in FIG. 5 in an initial state with liquid and air in the liner, e.g., prior to feeding.
Figure 7:
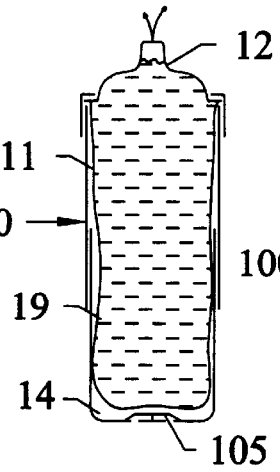
FIG. 7 is a cross-sectional view of the nursing bottle shown in FIG. 6 in which a lower portion of the body is slidable relative to the upper portion so that liquid in the liner rises and air is expelled from the liner.

FIG. 5 illustrates another embodiment of the present invention for a nursing bottle 101 having a body 100. In this embodiment, body 100 comprising two parts, an upper portion 102 comprising a hollow substantially cylindrical tube having an open upper end and an open bottom end, and a lower portion 104 comprising an open upper end and closed bottom end. Desirably, lower portion 104 includes an aperture 106 that is sealed with a check valve 105.

In this illustrated embodiment lower portion 104 acts as a pump for pressurizing air in chamber 14 and thus removing air in liner 11 as shown in FIGS. 6–9, in the manner as described above with respect to nursing bottle 81. Desirably, check valve 105 prevents air from escaping during this phase of the process.

Figure 8:
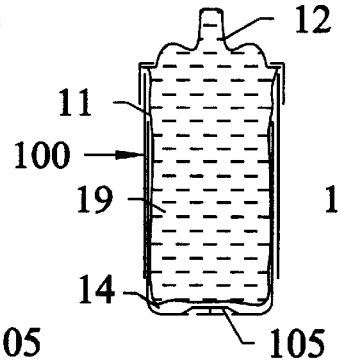
FIG. 8 is a cross-sectional view of the nursing bottle shown in FIG. 7 with no air in the liner, e.g., ready for feeding.
Figure 9:
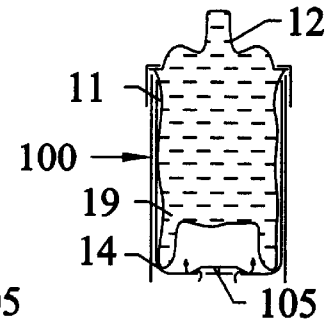
FIG. 9 is a cross-sectional view of the nursing bottle shown in FIG. 8 in a later stage of feeding.

As shown in FIG. 8, liner 11 has no air and chamber 14 has enough pressure to prevent the weight of liquid 19 in liner 11 from causing liner 11 to expand. As shown in FIG. 9, as an infant feeds from nursing 101, the volume of liner 11 decreases and the volume of chamber 14 increases. Then the volume of chamber 14 increases a sufficient amount, a pressure differential results in chamber 14, and advantageously, check valve 105 will again open to allow air into chamber 14.

Figure 10:
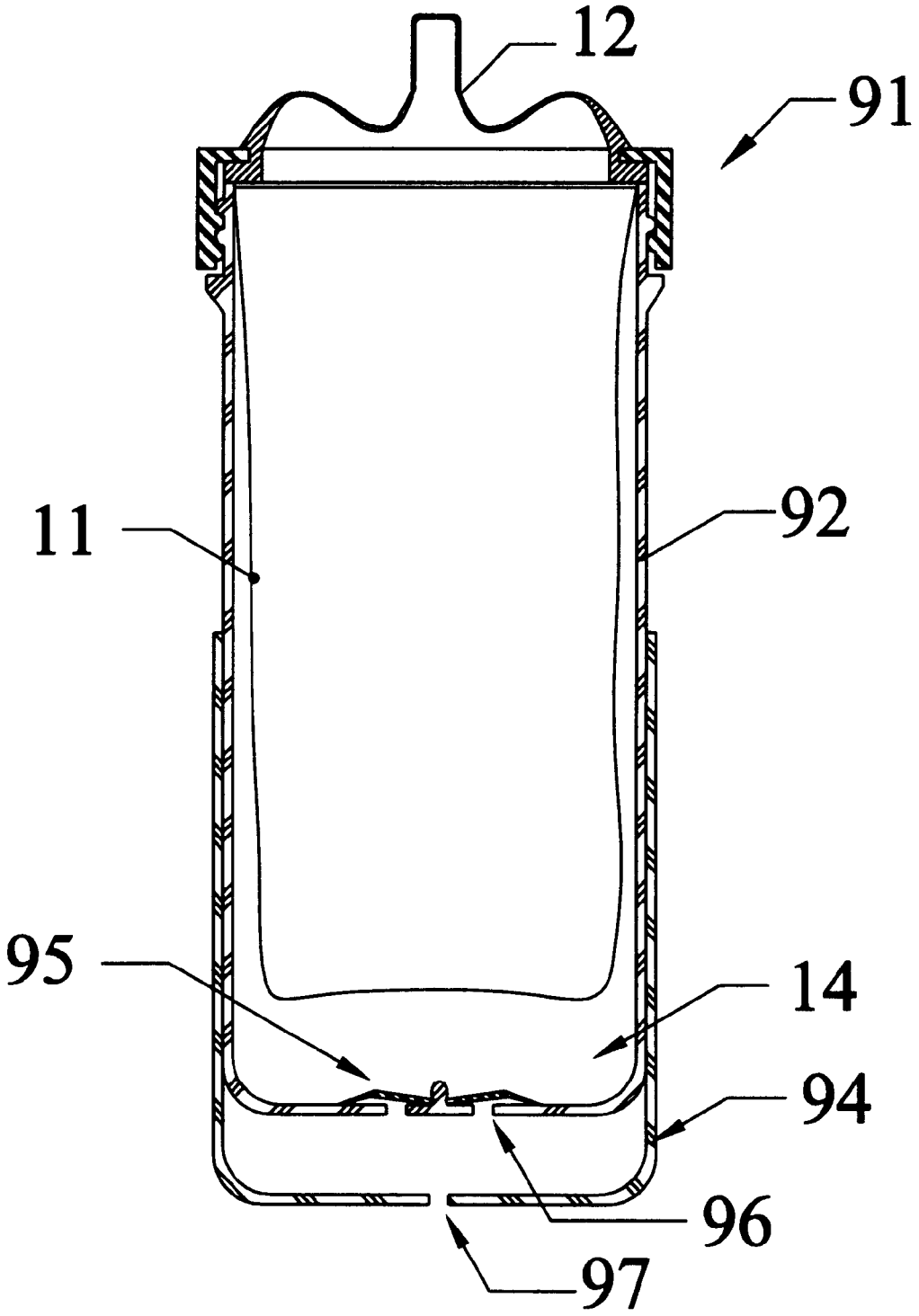
FIG. 10 is a cross sectional view of a nursing bottle with a valve, and the slidable pump attached.

FIG. 10 illustrates still another embodiment of the present invention for a nursing bottle 91 having a body 92 comprising a hollow substantially cylindrical tube with an aperture 96 and a valve 95 , and a lower portion 94 comprising an open upper end and orifice 97 on the bottom end. Upper and lower portions 92 and 94, respectively, are telescopically slidably and engageable with each other in, close fitting manner to pressurize air in chamber portion 92, e.g., holding upper portions 92 and 94 pushing them together causes air to escape through air regulating means, orifice 97, and air to enter chamber 14 through orifice 96

From the present invention it will be appreciated to those skilled in the art that the check valve and/or pump need not be placed on the bottom of the bottle but can be placed elsewhere on the body, e.g., on the body adjacent the top or open upper end to suit the particular application or for ease of manufacture, etc. Furthermore, the present design allows one to use the bottle even if a liner is not available, i.e., the employment of the bottle with a body having a check valve is usable without a liner although there may be air ingestion by the infant.

Thus, while only several embodiments of the present invention have been shown and described, many changes and modifications may be made relative thereto without departing from the spirit and scope of the invention.

What is claimed is:

1. A nursing bottle comprising:

two parts, an upper portion, comprising a rigid body having an open end and an aperture, and a lower portion comprising an open upper end and closed bottom, upper and lower parts are telescopically slidable and engageable with each other in a close fitting manner;

the upper portion has a flexible liner suspendable from said open end of said body; forming a chamber between said liner and rigid body, and a feeding nipple attachable to said open end of said body, the lower portion comprising an open upper end and a closed bottom end, whereby when pressure is applied to the lower portion, there is an increase of pressure within the chamber that forces out air trapped within the liner, when the lower portion is retracted, air is drawn into said chamber through a course or passage between said close fitting parts.

2. The bottle according to claim 1, that, when the lower portion is retracted, air is drawn into said chamber through an orifice in said lower portion.

3. The bottle according to claim 1, wherein said orifice contains a check valve.

4. The bottle according to claim 3, wherein said at least one check valve comprises silicone rubber.

5. The bottle according to claim 1, further comprising a retaining ring for attaching said nipple to said body.

6. The bottle according to claim 1, wherein the nipple is self-sealing.

7. The bottle according to claim 1, where the lower portion is the protective storage hood for the nipple.

8. A nursing bottle comprising:

two parts, an upper portion, comprising a rigid body having an open end and an aperture covered with a check valve, and a lower portion comprising an open upper end and closed bottom, upper and lower parts are telescopically slidable and engageable with each other in a close fitting manner;

the upper portion has a flexible liner suspendable from said open end of said body; forming a chamber between said liner and rigid body, and a feeding nipple attachable to said open end of said body, the lower portion comprising an open upper end and a bottom end with an aperture whereby when pressure is applied to the lower portion, there is an increase of pressure within the chamber that forces out air trapped within the liner, when the lower portion is retracted, air is drawn into said chamber through a course or passage between said close fitting parts.

9. The bottle according to claim 8, that, when the lower portion is retracted, air is drawn into said chamber through an orifice in said lower portion.

10. The bottle according to claim 8, wherein said lower portion contains a check valve.

11. The bottle according to claim 10, wherein said at least one check valve comprises silicone rubber.

12. The bottle according to claim 8, further comprising a retaining ring for attaching said nipple to said body.

13. The bottle according to claim 8, wherein the nipple is self-sealing.

14. The bottle according to claim 8, where the lower portion is the protective storage hood for the nipple.

* * * * *